United States Patent [19]

Ishii

[11] Patent Number: 4,686,740

[45] Date of Patent: Aug. 18, 1987

[54] STOPPER FOR DOOR

[75] Inventor: Hiroyuki Ishii, Tokyo, Japan

[73] Assignee: Sugatsune Industrial Co., Ltd., Tokyo, Japan

[21] Appl. No.: 758,687

[22] Filed: Jul. 25, 1985

[51] Int. Cl.[4] ..... E05C 1/02

[52] U.S. Cl. ..... 16/85; 16/DIG. 17; 292/181; 292/DIG. 4

[58] Field of Search ..... 292/DIG. 4, DIG. 15, 292/181, 338, 62; 16/85, 86 R, 86 A, 86 B, 86 C, DIG. 17

[56] References Cited

U.S. PATENT DOCUMENTS

| | | | |
|---|---|---|---|
| 537,250 | 4/1895 | Tynon | 292/62 |
| 643,850 | 2/1900 | Rogers | 292/181 |
| 684,586 | 10/1901 | Neher | 292/181 |
| 4,050,723 | 9/1977 | Papadatos | 292/DIG. 15 |
| 4,331,355 | 5/1982 | Okuno | 292/DIG. 4 |
| 4,479,566 | 10/1984 | Ishii | 16/35 R |

*Primary Examiner*—M. Jordan

*Attorney, Agent, or Firm*—Schwartz, Jeffery, Schwaab, Mack, Blumenthal & Evans

[57] ABSTRACT

A stopper which has a rod projected from the lower end opening in a hollow body to be slidable in upward and downward directions and mounted to be urged by the lifting force of a spring, a pedal attached to the rod, and an actuator formed symmetrically with recesses and rotatably supported to one side of the rod. The body is formed with a guide slot 8 adapted so that the actuator is disposed in a predetermined direction slidably in upward and downward directions therein, a rotary controller for rotating the actuator in a predetermined angle, and a connector for engaging the actuator at a predetermined angle, the rod formed to be able to be axially contracted and elongated and returned. Thus, the stopper can lock and release the lock merely by depressing the pedal, thereby improving the operability and permitting locking in a predetermined stroke.

4 Claims, 5 Drawing Figures

STOPPER FOR DOOR

This invention relates to a stopper used, for example, for a carrying implement, a bed, a door or the like to prevent the implement from moving.

The conventional stopper of this type, shown in FIG. 1 is heretofore known. This stopper has a body a, a lever b mounted rockably in upward and downward directions on the body a and a rod c inserted slidably in upward and downward direction into the through hole of the lever b. A lifting force is applied to the rod c by a spring, not shown, and the force is applied by a spring d to the lever b in a movable hook type. Thus, the stopper is locked in the depressed state as designated by a broken line by depressing the rod c, and the lever b is depressed against the tension of the spring d to be rocked, thereby releasing the locked state.

However, according to the stopper of the construction described above, when the rod c and the through holes of the lever b are worn or the spring d is elastically fatigued, both are fluctuated to cause both to be insufficiently frictionally engaged, resulting in an incomplete lock. Or, it is necessary to mount the stopper at the door by considerably largely setting an interval between a floor surface e and the lower end of the rod c in the lock released state by considering the wears of the body. Accordingly, when the stopper is used for a low height such as, for example, a carrying implement, the stopper is projected upwardly in a long length from a load carrier to disturb the loading and unloading of the luggage. Since it is necessary to individually depress the rod c and the lever b to lock and unlock, and the operability is not thus satisfied.

Accordingly, an object of this invention is to provide a stopper for a door or the like which can eliminate the aforementioned drawbacks of the conventional stopper and can lock and release the lock merely by depressing a pedal, thereby improving the operability and permitting locking in a predetermined stroke.

The above and other related objects and features of the invention will be apparent from a reading of the following description of the disclosure found in the accompanying drawings and the novelty thereof pointed out in the appended claims.

BRIEF DESCRIPTION OF THE DRAWINGS

FIG. 1 is a side view showing a conventional stopper for a door or the like:

The present invention will now be described in detail with reference to the accompanying drawings.

DESCRIPTION OF THE PREFERRED EMBODIMENTS

Figure 1:
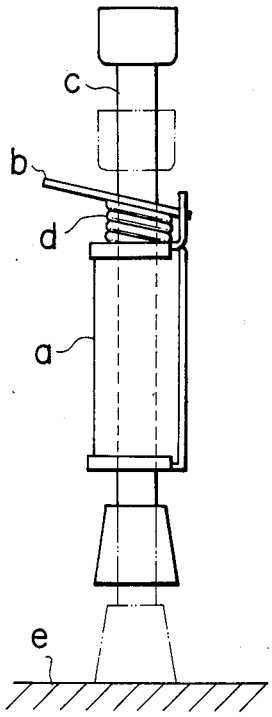
Figure 2:
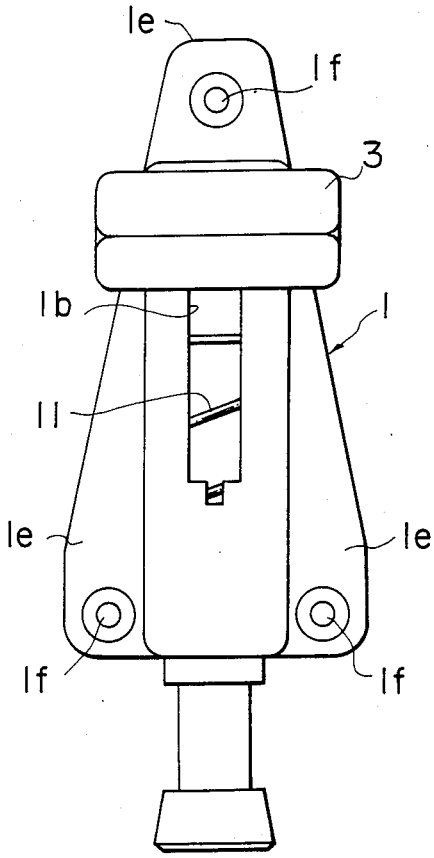
FIG. 2 is a front view showing an embodiment of a stopper according to the present invention.
Figure 3:
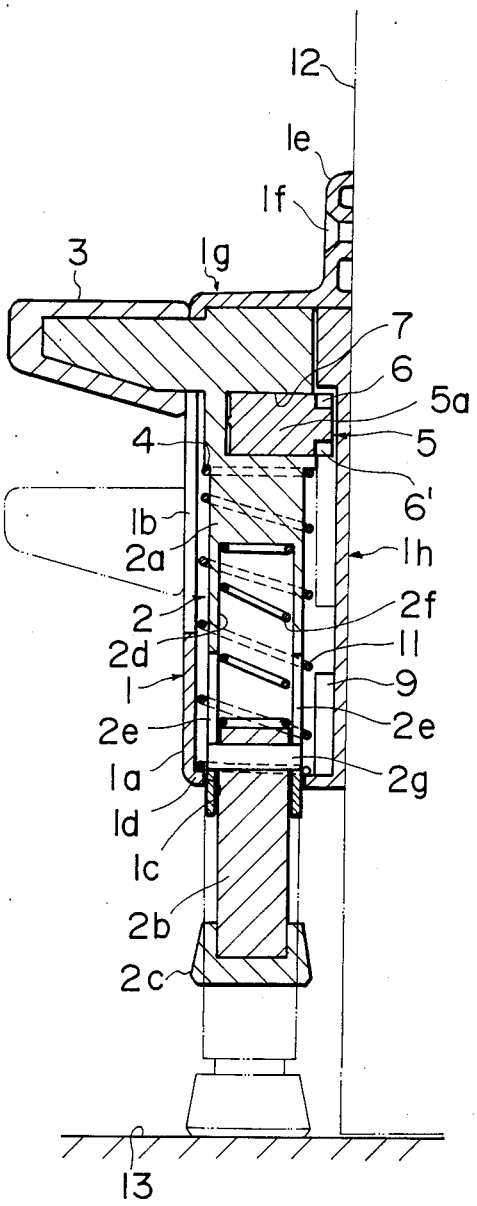
FIG. 3 is a longitudinal sectional side view of the stopper of FIG. 2.
Figure 4:
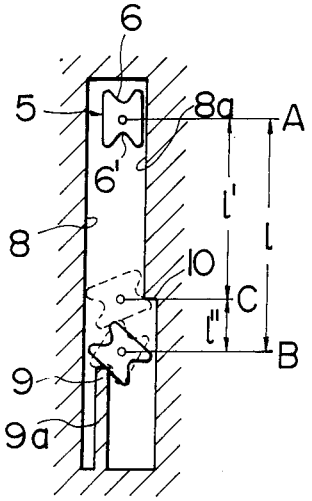
FIG. 4 is a front view showing the positional relationship between an actuator, a guide slot, a rotary controller and a connector in the stopper.

As shown in FIGS. 2 to 4, a body 1 is formed in a longitudinally long hollow shape, opened with a longitudinally long hole 1*b* at the front wall 1*a*, and also opened with an opening portion 1*c* at the lower end.

A rod 2 extends downwardly from the opening portion 1*c* and a pedal 3 projects forwardly from the upper end of the rod and is integrally formed therewith. The rod slides upwardly and downwardly relative to the body 1. The pedal 3 projects from the long hole 1*b* to be operable to be depressed. The rod 2 is urged by a lifting force of a spring 11 which is externally mounted on the rod and supported at one end thereof to the peripheral edge 1*d* near the opening portion 1*c* of the body 1, and at the other end thereof to the downward stepped portion 4 formed at the lower periphery of the rod 2. The rod 2 is held in the raised position as designated by solid lines in FIG. 3, and can be depressed against the spring 11 in a range of the effective length of the long hole 1*b* of the body 1, through which the pedal 3 extends.

Further, an actuator 5 is supported rotatably and laterally faced to one side upper portion of the rod 2, i.e., to the upper portion of the back wall.

The actuator 5 has a predetermined lateral width, and recessed 6 and 6' formed outwardly in substantially V shape in a front view symmetrically at both upper and lower ends thereof in a suitable thickness. The actuator is formed integrally with the front end of the cylindrical shaft 5*a* thereof as shown, or formed separately with another member from the cylindrical shaft journaled at the center rotatably to the front end of the cylindrical shaft, not shown.

As described above, in the exemplified embodiment, an axial bore 7 adapted for the cylindrical shaft 5*a* is laterally opened at the upper portion of the back wall of the rod 2 in such a manner that the cylindrical shaft 5*a* is engaged within the hole 7 so that the actuator 5 is rotatably supported to the rod 2.

The body 1 is formed in the inner wall opposite to the actuator 5 with a guide slot 8 adapted to be capable of guiding the actuator 5 in upward and downward directions in the state that the actuator 5 is directed in a predetermined direction, i.e., the recesses 6 and 6' are directed in upward and downward directions; a rotary controller 9 for rotating the actuator 5 at a predetermined direction (approx. 45° clockwise in this embodiment) in contact with one side of the lower recess 6' by the depressed actuator 5; and a connector 10 for holding the rod 2 in the depressed position in engagement with one side of the upper recess 6 in the state that the actuator 5 is rotated at a predetermined angle by the controller 9.

The actuator 5 is held at the position A (FIG. 4) by the spring 11 in the state that the rod 2 is lifted and held at the position designated by solid lines in FIG. 3. Thus, the actuator 5 is depressed together with the rod 2, engaged with the connector 10 at the point c, and held at the stopping position designated by broken lines in FIG. 3. In this case, the actuator 5 is temporarily moved down from the position A to the position B in the stroke L, rotated at a predetermined angle by the controller 9, and then raised and returned from the position B to the position C in the stroke L" to be engaged with the connector 10. Thus, since the rod 2 must have a depressing margin corresponding to the stroke L" from the position B to the position C, the rod 2 is formed to be able to axially contract and elongate in length corresponding to the stroke L".

In this case, the body 1 is preferably formed with an outer cover 1*g* formed integrally with extended portions 1*e* formed with threaded holes 1*f* to be clamped by screws to a door 12. Then, a back cover 1*h* is clamped with screws to the back opening of the outer cover 1*g*, or bonded with an adhesive to the outer cover 1*g*. In such a structure, after the rod 2, the spring 11 and the actuator 5 are associated in the outer cover 1*g*, the back cover 1*h* is secured, and the guide slot 8, the rotary controller 9 and the connector 10 are formed in the inner wall of the back cover 1*h*.

As means for contracting or elongating to return the rod 2, a first rod section 2*a* and a second rod section 2*b* are telescopically mounted, and the tension of the spring 2*f* is urged in the elongating direction. An elastic member 2*c* made of rubber which can be axially compressed or elastically returned can also be provided at the lower end of the rod 2 for the same purpose.

In case of the abovementioned means, a guide recess 2*d* is formed in a suitable long length in the axial direction at the center of the lower end of the first rod section 2*a*, and longitudinal holes 2*e* and 2*e* are opposed on the peripheral wall.

On the other hand, the second rod section 2*b* is formed to have a diameter to be engaged with the guide recess 2*d*. Thus, after the second rod section 2*b* contacts a compression spring 2*f* in the recess 2*d*, a spring pin 2*g* is passed laterally through an opening at the upper end of the rod section 2*b*, both projected ends of the pin are being slidably engaged with the holes 2*e*, 2*e* to retain the rod section 2*b* and permit the same to be moved relative to the rod section 2*a*. In the embodiment shown in FIG. 4, the rotary controller 9 and projection 9*a* are at the position slightly displaced from the center toward one side (left side of FIG. 4) at the lower portion of the guide slot 8, and the connector 10 comprises a downward step formed at the lower portion of one side wall 8*a* of the slot 8.

Figure 5:
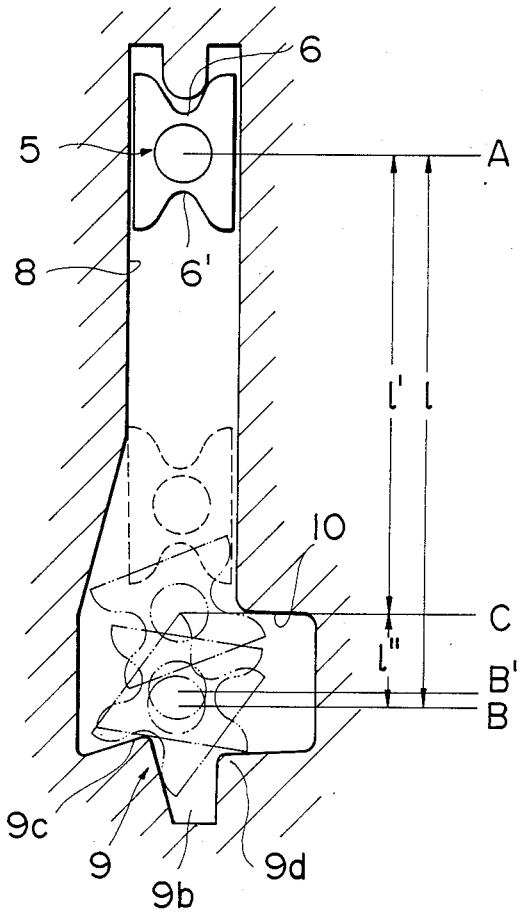
FIG. 5 is a front view showing another embodiment of the stopper incorporating an actuator, a guide slot, a rotary controller and a connector according to the invention.

FIG. 5 shows another embodiment of the guide slot 8, the rotary controller 9 and the connector 10. The rotary controller 9 is formed with a recess 9*b* at the center, and projections 9*c* and 9*d* of different heights at both left and right sides thereof.

In the embodiment shown in FIG. 4, when the rod 2 is depressed to the stopped state or stop released state, the actuator 5 is rotated to the position B. On the other hand, in the embodiment in FIG. 5, when the rod 2 is depressed to the stopped state, the actuator 5 is rotated to the position B, while when the stop is released, it is rotated to the position B'. In both embodiments, the rods 2 are moved from the lifting limit to the stop position C substantially in the stroke L'.

In the structure of the embodiments described above, when the stopper is used for a door, the body 1 is fixed in the stroke L' of an interval from the lower end of the rod 2 to the floor surface 13 at the lower portion of the door 12.

Then, after the door 12 is opened, the pedal 3 is depressed to move down the rod 2 against the tension of the spring, the lower end of the rod 2 contacting the floor surface 13. When the pedal 3 is further depressed, the rod 2 is prevented from downwardly moving any further by the floor surface 13. Thus, the rod 2 itself is contracted axially, with the rod section 2*a* moving downwardly relative to the rod section 2*b*. The actuator 5 is thereby moved down, and makes contact with the controller 9.

The actuator 5 moves down from the position A to the position B in the stroke L as shown in FIG. 4, and the direction of the actuator 5 is initially in the state disposed at the position A. Thus, when the actuator 5 moves down to the position B, one side (left side in FIG. 4) of the recess 6' of the actuator 5 makes contact with the controller 9.

Therefore, the actuator 5 is rotated at 45° in clockwise direction at the position B.

Then, when the depression of the pedal 3 is released, the rod 2 and actuator 5 are raised by the tension of the spring 11. At this time, one side of the recess 6 of the actuator 5 directly engages the connector 10. Then, one side end of the recess 6' makes contact with the side wall of the guide slot 8. Thus, the actuator 5 is engaged and held at the position C, thereby preventing the rod 2 from rising. As shown by the dashed lines in FIG. 3, the rod 2 is clamped at the lower end at the position projected to the floor surface 13, and the door 12 is locked and held by the frictional engaging force of both.

More particularly, after the rod 2 is depressed from the position A to the position B in the stroke L, the rod 2 is temporarily raised from the position B to the position C in the stroke L'', and the actuator 5 is engaged with the connector 10. At this time, when the rod 2 itself is axially elongated, the rod 2 is held the lower end in the state contacted with the floor surface 13.

When the pedal 3 is depressed in the abovementioned door stopped state, the rod 2 itself through rod sections 2*a* and 2*b*, is axially contracted. Thus, the actuator 5 is moved down from the position C to the position B, and the actuator 5 makes contact at one side of the side wall with the controller 9. Therefore, the actuator 5 is rotated clockwise approx. 45° at the position B as designated by a solid line in the drawings.

Then, when the pedal 3 is released from the depression, the rod 2 is raised together with the actuator 5 by the tension of the spring. Thus, the actuator 5 is guided at the left end of the drawings to the side wall of the guide slot 8. In this manner, the actuator 5 is returned to the same attitude as that disposed at the position A, and can be moved upward along the slot 8. Therefore, the rod 2 rises to the upper limit, and stops. The actuator 5 is returned to the position A of the drawings, thereby releasing the stopping state of the door 12.

In other words, the door 12 can be locked and released from locking by pushing or depressing the pedal 3.

According to the stopper for a door of the present invention as described above, the stopper comprises a rod 2 projected from the lower end opening 1*a* in a hollow body 1 and slidable in upward and downward directions and mounted to be urged by the lifting force of a spring 11. A pedal 3 is attached to the rod 2, and an actuator 5 is formed symmetrically with recesses 6 and 6' and rotatably supported to one side of the rod 2. The body 1 is formed with a guide slot 8 adapted so that the actuator 5 is disposed in a pedetermined direction slidably in upward and downward directions therein. A rotary controller 9 rotates the actuator 5 to a predetermined angle, and a connector 10 engages the actuator 5 at such predetermined angle. The rod 2 is formed to be able to be axially contracted and elongated and returned. Therefore, when the stopper is clamped at the lower portion of the door 12 and used as a stopper for the door, the rod 2 is moved down by depressing the pedal 3 to frictionally engage the floor surface 13 so as to hold the door 12 in a desired opening angle. When the stopper is to be released, the pedal 3 is depressed. Thus, the stopper may be stopped and released from stopping readily by a sole operation of a single member. In this manner, the operability of the stopper of this type is improved. Since the actuator 5 is temporarily set back but the rod 2 itself is axially contracted and elongated and returned with a depressing margin, sufficient frictional engaging force can be obtained for the floor surface 13. The stopper can be firmly stopped, and provides a remedy against the irregular dimensions of the members and irregular mounting sizes of the stopper. Further, since the stopper can absorb the impact force when depressing the pedal 3, the stopper can prevent the floor surface 13 and the components from damage with excellent durability.

What is claimed is:

1. A stopper for a movable member such as a door or the like, comprising:

(a) a hollow body adapted to be secured to the member, said body including a lower end opening, a front wall formed with a vertically extending front guide slot, and a rear wall, (b) rod means positioned in said housing for slidable movement in an upward and downward direction relative to said housing, the lower portion of said rod means projecting downwardly below said lower end opening of said housing for stopping contact with a supporting surface, said rod means being constructed and arranged to be axially contractible, (c) a laterally projecting pedal positioned at the top of said rod means by means of which said rod means can be depressed relative to said housing, said pedal traveling in said front guide slot, (d) means for biasing said pedal and said rod means upwardly away from a stop position, (e) an actuator mounted in said rod means for rotation about an axis generally perpendicular to the axis of said rod means, said actuator having a portion extending laterally and rearwardly from said rod means, said actuator being formed with symmetrical, opposed recesses in the laterally extended portion thereof, (f) a second guide slot in the rear wall of said housing, said actuator being movable upwardly and downwardly in said second guide slot, said guide slot being formed with or having positioned therein first and second contact points for contacting and orienting said actuator as said actuator travels in said slot, whereby depression of said rod means to a stop position causes said actuator to engage said second contact point and be so oriented to retain said rod means in said stop position, and subsequent depression of said rod means effects contraction of said rod means and reorientation of said actuator by said first and second contact points to permit said actuator to be raised in said second guide slot to return said rod means to a rest position.

2. The stopper as claimed in claim 1, wherein said rod means comprises a first rod section and a second rod section telescopically received within said first rod section for longitudinal movement relative thereto, and spring means internally engaging said first and second rod sections for biasing the same toward an expanded position.

3. The stopper as claimed in claim 1, wherein said rod means comprises a first rod section and a second rod section telescopically received within said first wall section and longitudinally movable relative thereto, and biasing means attached to said second rod section for urging said rod section to a contracted position.

4. The stopper as claimed in claim 1, wherein said first contact point comprises an elongated rotation control member extending upwardly from the bottom of said second guide slot, and said second point comprises a shoulder partially defining one wall of said second guide slot.

* * * * *